US007181040B2

(12) United States Patent
Ohta

(10) Patent No.: US 7,181,040 B2
(45) Date of Patent: Feb. 20, 2007

(54) CASE FOR CONTAINING ELECTRICAL INSTRUMENT

(75) Inventor: Yoshizumi Ohta, Yamanashi (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 155 days.

(21) Appl. No.: 10/787,076

(22) Filed: Feb. 27, 2004

(65) Prior Publication Data

US 2004/0170298 A1 Sep. 2, 2004

(30) Foreign Application Priority Data

Feb. 28, 2003 (JP) ..... P2003-052777

(51) Int. Cl.
*H04R 25/00* (2006.01)

(52) U.S. Cl. ..... 381/398; 381/396; 381/433

(58) Field of Classification Search ..... 381/151, 381/398, 152, 391, 396, 189, 412, 171, 431, 381/172, 400, 420, 371, 372, 433, 388.1; 340/384.1, 311.1, 407.1, 825.46, 7.6
See application file for complete search history.

(56) References Cited

U.S. PATENT DOCUMENTS 6,513,623 B2 * 2/2003 Sugiyama et al. ..... 181/161
6,618,487 B1 * 9/2003 Azima et al. ..... 381/152
6,895,099 B2 * 5/2005 Lee et al. ..... 381/396
2002/0114473 A1 8/2002 Kuwabara
2003/0044040 A1 3/2003 Lee et al.

FOREIGN PATENT DOCUMENTS

| | | | |
|---|---|---|---|
| EP | 0 315 400 | A2 | 5/1989 |
| JP | 02-044998 | A | 2/1990 |
| JP | 2000-325880 | A | 11/2000 |
| JP | 2001-102769 | A | 4/2001 |

* cited by examiner

*Primary Examiner*—Suhan Ni
(74) *Attorney, Agent, or Firm*—Browdy and Neimark, PLLC

(57) ABSTRACT

A case for containing an electrical instrument, comprises a frame having a peripheral wall portion, a cover member having a peripheral wall portion fitted on the peripheral wall portion of said frame and configured to form a space for containing the electrical instrument between the frame and the cover member, at least one hole provided in one of the peripheral wall portions of the frame and the cover member to fix the frame and the cover member, and a protrusion provided on the other of the peripheral wall portions of the frame and the cover member for being inserted in said hole.

8 Claims, 8 Drawing Sheets

CASE FOR CONTAINING ELECTRICAL INSTRUMENT

BACKGROUND OF THE INVENTION

1. Field of the Invention

The present invention relates to an improvement in a case for containing an electrical instrument such as a micro-speaker installed in a mobile communication instrument of a mobile phone and so on.

2. Description of the Prior Art

Conventionally, for example, a speaker used widely in a mobile communication instrument such as a mobile phone, a PDA (Personal Digital Assistant), a pager, a small game machine and so on comprises a case and an electrical instrument such as a sound generator, contained in the case.

Because such a micro-speaker is formed into a small chip similarly to the other electronic parts and practiced in a surface-mounting type capable of soldering only on one surface of a circuit substrate so as to be adapted to mount the parts with a high density mounting on the circuit substrate of the mobile communication instrument, it is required that the case is formed in a thinned type and configured to contain efficiently and inexpensively the electrical instrument.

A case in such a conventional micro-speaker of the surface-mounting type has a frame 1 and a cover member 2 attached to the frame 1, as shown in FIG. 6. When the cover member 2 is attached to the frame 1, a sound generator (not shown), which is an electrical instrument, is contained in a space 3 between the cover member 2 and the frame 1. The frame 1 and the cover member 2 form the case by inserting an outer peripheral surface 4 of the frame in an inner peripheral surface 5 of the cover member 2.

In this case, an adhesive is applied on at least one of an inner peripheral surface of the cover member 2 and the outer peripheral surface 4 of the frame 1 and then the adhesive is hardened by means of heating to fix the cover member 2 to the frame 1.

However, in the conventional case as described above, because there are variations in an amount of the adhesive applied between the cover member 2 and the frame 1, there are also generated variations in a force of fixing, in other words, a force of combining, the cover member and frame. Consequently, the strength of the case in a drop impact is insufficient and the cover member 2 cannot be mounted properly on the frame 1 and therefore a height of an assembly of the cover member 2 and frame 1 tends to become uneven.

SUMMARY OF THE INVENTION

The present invention is made to resolve the above problems in the prior art and it is therefore an object of the present invention to provide a case for containing an electrical instrument having a cost reduction by the reduction of an adhesive process, a sufficient mounting strength of parts, and a high reliability.

To attain the above object, a case for containing an electrical instrument, according to the present invention comprises: a frame having a peripheral wall portion; a cover member having a peripheral wall portion fitted on the peripheral wall portion of said frame and configured to form a space for containing the electrical instrument between the frame and the cover member; at least one hole provided in one of the peripheral wall portions of the frame and the cover member to fix the frame and the cover member; and a protrusion provided on the other of the peripheral wall portions of the frame and the cover member for being inserted in the hole.

The case for containing the electrical instrument also includes a lock part for locking the frame and the cover member.

DETAILED DESCRIPTION OF THE PREFERRED EMBODIMENTS

An embodiment of the present invention will be explained in detail with reference to the accompanying drawings below.

Figure 1:
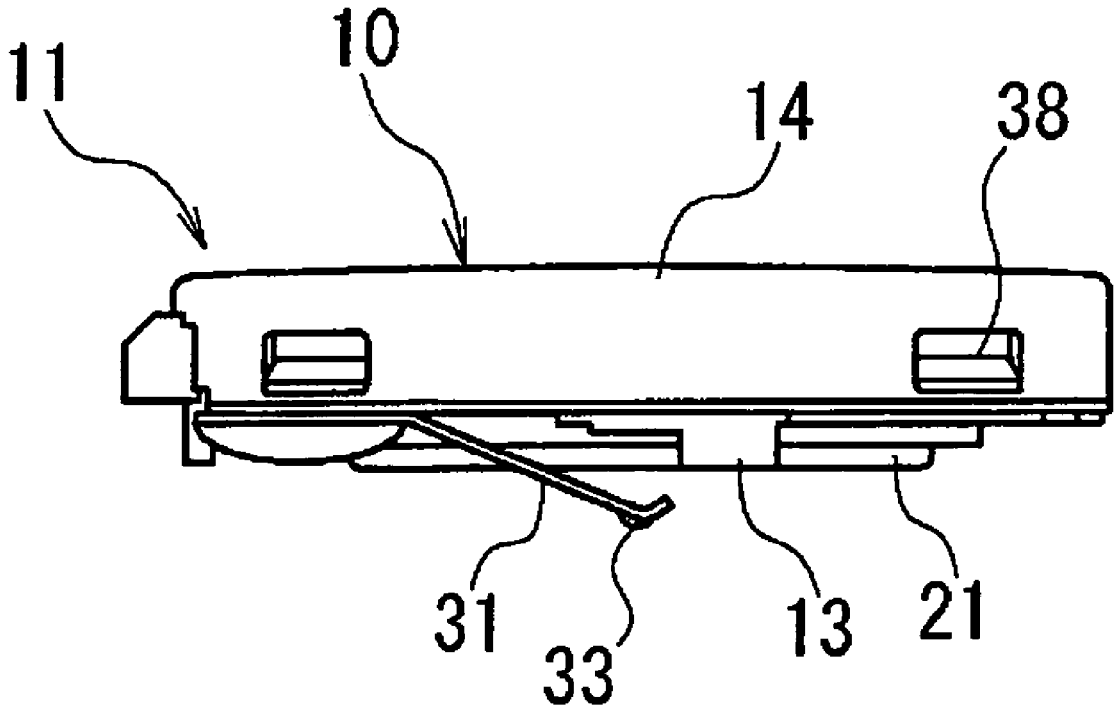
FIG. 1 is a side view of a micro-speaker to which a case for containing an instrument according to the present invention is applied.
Figure 2:
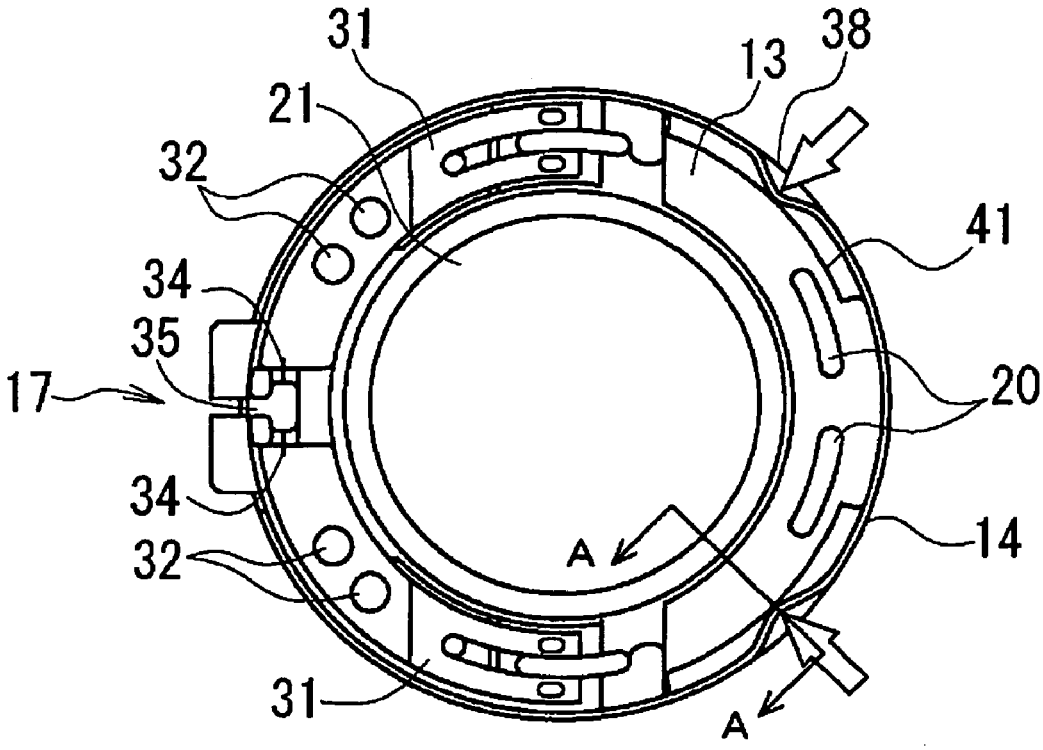
FIG. 2 is a bottom view of the micro-speaker as shown in FIG. 1.
Figure 3:
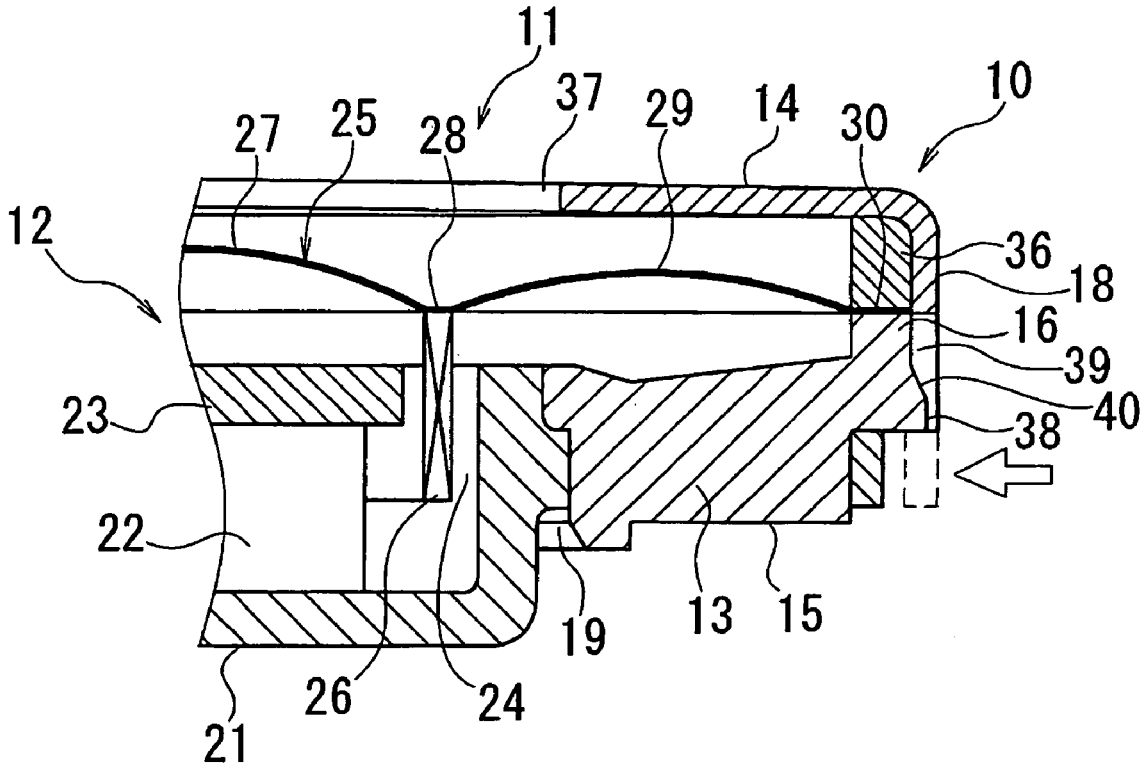
FIG. 3 is a sectional view taken along A—A line in FIG. 2.

FIGS. 1 to 3 illustrate an embodiment in which a case 10 for containing an electrical instrument according to the present invention is applied to a micro-speaker 11, for example. The micro-speaker 11 comprises the case 10 for containing the electrical instrument and an sound generator 12 (FIG. 3) disposed within the case 10.

The case 10 for containing the electrical instrument includes a frame 13 and a cover member 14 attached on the frame 13 in one embodiment.

As shown in FIG. 3, the frame 13 comprises an annular dish-shaped resin forming body having a bottom wall 15, a peripheral wall portion 16 extending upwardly from the bottom wall 15, and a bifurcated portion 17 (FIG. 2) provided in one portion of the peripheral wall portion 16. The cover member 14 is formed from a metal plate of a thin thickness, for example, and has a peripheral wall portion 18 in which the peripheral wall portion 16 of the frame 13 is smoothly inserted. A method for mounting the cover member 14 on the frame 13 will be described hereinafter.

The frame 13 is provided with a bore 19 disposed at a central portion of the bottom wall 15 and a plurality of bores 20 (see FIG. 2) for discharging air when the vibrating plate 25 vibrates, disposed between the bore 19 and peripheral wall portion 16.

The sound generator 12 includes a dish-like yoke 21 comprising a magnetic body fitted and fixed in the bore 19 of the frame 13, a permanent magnet 22 having upper and lower magnetic poles, fixed on a central portion of a bottom surface of the yoke 21, and a circular plate-shaped top plate 23 fixed on a magnetic surface of the permanent magnet 22, as shown in FIG. 3.

A magnetic circuit part is configured by the yoke 21, permanent magnet 22 and top plate 23, and a magnetic circuit is also formed passing through a space 24 formed between an upper end portion of the yoke 21 and a peripheral edge portion of the top plate 23.

The sound generator 12 has also a vibrating plate 25 and a voice coil 26 fixed to the vibrating plate 25. The vibrating plate 25 comprises a disc plate having a central spherical portion 27, a peripheral spherical portion 29 connected through a flat portion 28 with the central spherical portion 27, and a peripheral edge portion 30 extending horizontally from the peripheral spherical portion 29, and is formed of a plastic material integrally. The peripheral edge portion 30 of the vibrating plate 25 is fixed adhesively on an upper end of the peripheral wall portion 16 of the frame 13 or on a lower surface of a ring, which will be described below.

The voice coil 26 comprises an annular coreless coil in which a coil wire which is a copper wire covered with enamel is adapted to be wound into a rectangular shape in section and fixed with a painting. An upper surface of the voice coil 26 is fixed adhesively to a lower surface of the flat portion 28 of the vibrating plate 25. An approximately half of height of the voice coil 26 is inserted into the space 24 between the peripheral edge portion of the top plate 23 and the upper end portion of the yoke 21(see FIG. 3).

A pair of contact springs 31 of circular arc plate spring type is fixed on a lower surface of the frame 13 by heat caulking of two pins 32, respectively. The contact springs 31 are bent downwardly at an intermediate portion thereof. Each of the contact springs 31 is bifurcated, a convex portion 33 is formed in the vicinity of a leading end portion of each contact spring 31 (see FIGS. 1 and 5), and the leading end portion is curved upwardly. Terminals 34 of the winding wire of the voice coil 26 are introduced out of the bifurcated portion 17 and ends of the terminals are exposed over the lower surface of the frame 13, and then the exposed ends of the terminals are connected with the contact springs 31 by soldering (see FIG. 2).

When the micro-speaker 11 is mounted on a circuit substrate (not shown) in the communication instrument, the contact springs 31 are pressed and then the convex portions 33 contact under pressure on a wiring pattern on the circuit substrate to conduct electrically the micro-speaker 11 and the wiring pattern.

In addition, reference numeral 36 denotes the ring as described above. The ring 36 is disposed on the peripheral edge portion 30 of the vibrating plate 25 (see FIG. 3). Moreover, the cover member 14 is provided with holes 37 for discharging a sound, as shown in FIG. 3.

If a voice signal is inputted through the contact springs 31 in the voice coil 26 of the speaker 11, a magnetic force is operated in the voice coil 26 in the magnetic circuit in accordance with the left-hand rule of Fleming and the vibrating plate 25 vibrates forwardly and backwardly to generate the sound.

Figure 5:
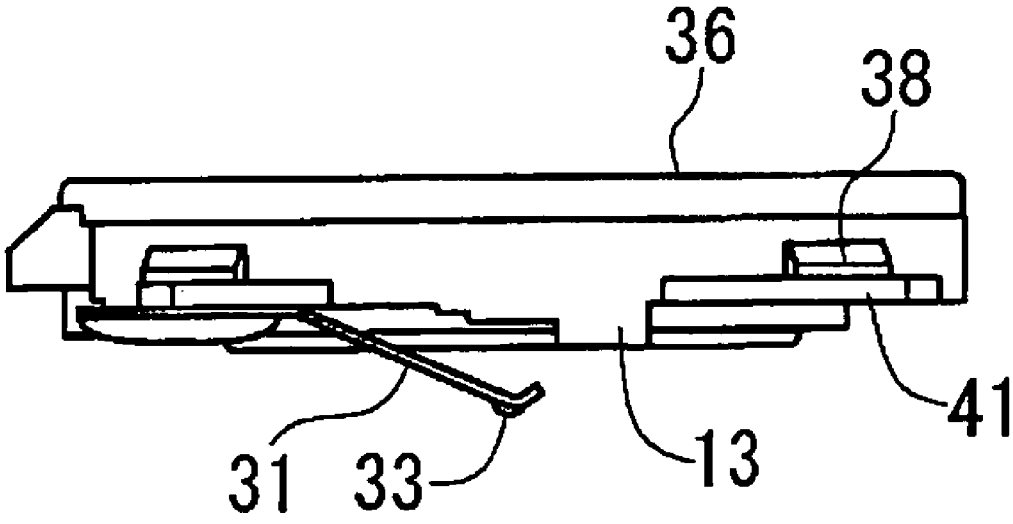
FIG. 5 is a sectional view of a frame in the case for containing the electrical instrument.
Figure 6:
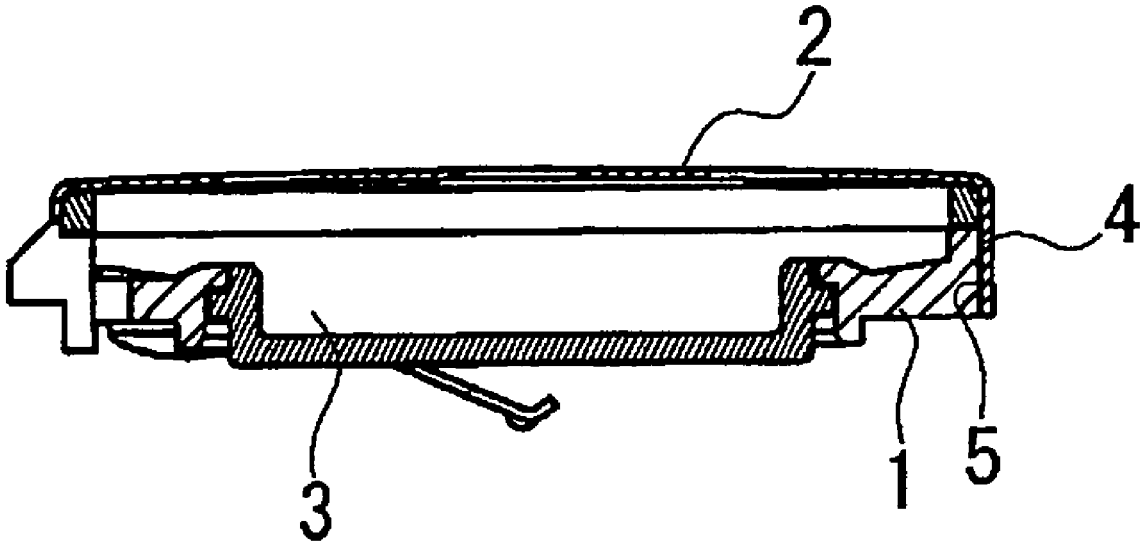
FIG. 6 is a sectional view of a conventional case for containing an electrical instrument.
Figure 7:
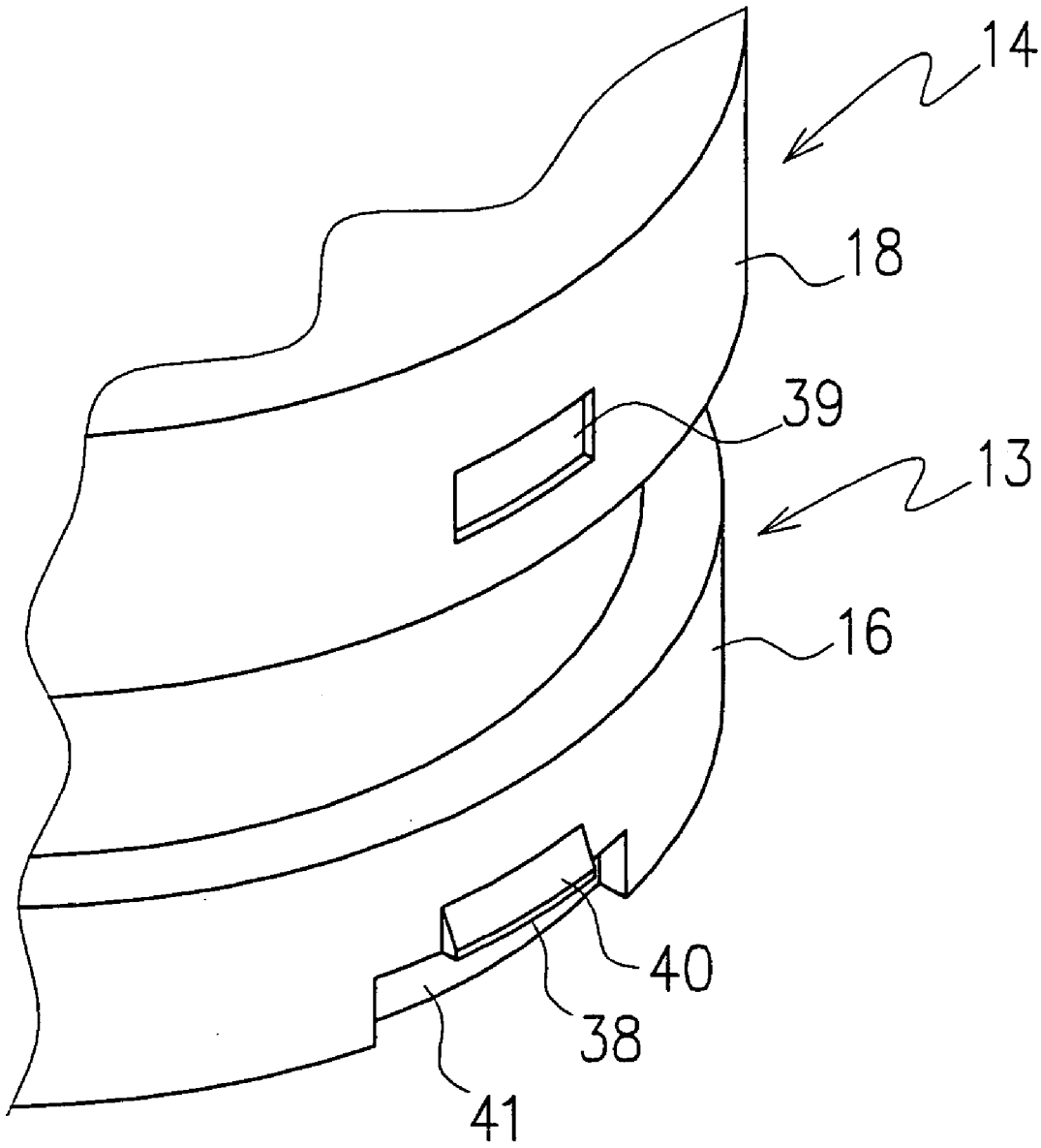
FIG. 7 is a partial perspective view of the cover and frame according to one embodiment.
Figure 8:
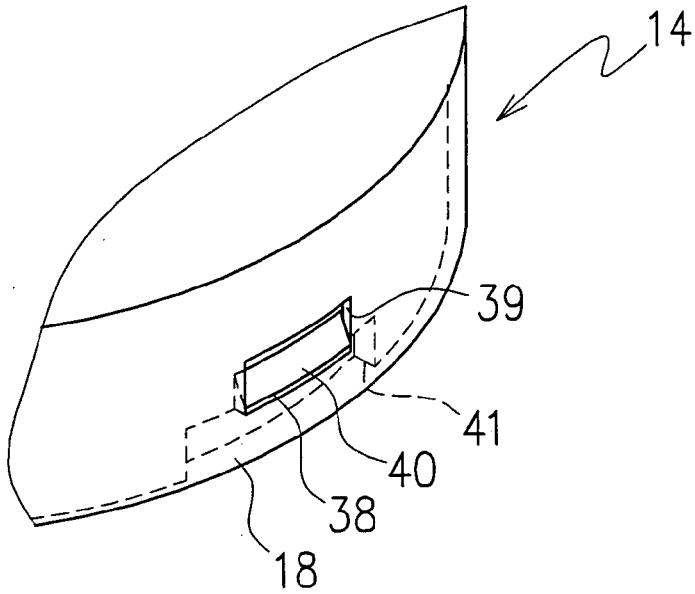
FIG. 8 is a partial perspective view of the cover and frame in engagement with one another according to one embodiment.

The cover member 14 is fixed on the frame from above of the ring 36. More specifically, for example, four protrusions 38 are configured to be equally spaced peripherally of the frame 13 on the peripheral wall portion 16 of the frame 13, in the embodiment, on one of the cover member 14 and the frame 13. These protrusions 38 have approximately rectangular shape as viewed from front, as shown in FIGS. 1 and 5. The peripheral wall portion 18 of the cover member 14 is provided with rectangular holes 39 in which the protrusions of the frame 13 are snappingly inserted. An upper portion of each of the protrusions 38 is formed to have a smoothly inclined surface 40 in such a way that an opening edge of the peripheral wall portion 18 of the cover member 14 can be passed easily on the protrusions 38 (see FIG. 3 and FIGS. 7–9).

Furthermore, a projected height of each protrusion 38 from the peripheral wall portion 16 is set to become generally the same as the thickness of the peripheral wall portion 18 of the cover member 14. With such a configuration, there are advantageous effects that when the protrusions 38 are inserted in the holes 39, a leading end of each protrusion 38 is not projected from an outer surface of the peripheral wall portion 18 of the cover member 14 and therefore it is avoided to inflict a wound or the like on a worker or use and to lose the appearance of the speaker.

From the above, the cover member 14 covers the frame 13, the peripheral wall portion 18 of the cover member 14 is then moved to slide on the peripheral wall portion 16 of the frame 13, and the protrusions 38 of the frame 13 are thus slipped into the holes 39 of the cover member 14 (see FIGS. 8–9) With such a structure, the cover member 14 can be mounted on the frame 13 with one-touch operation.

A lock part is provided between the frame 13 and cover member 14 in order to further secure the aforementioned mounting of the frame 13 and cover member 14.

Figure 4:
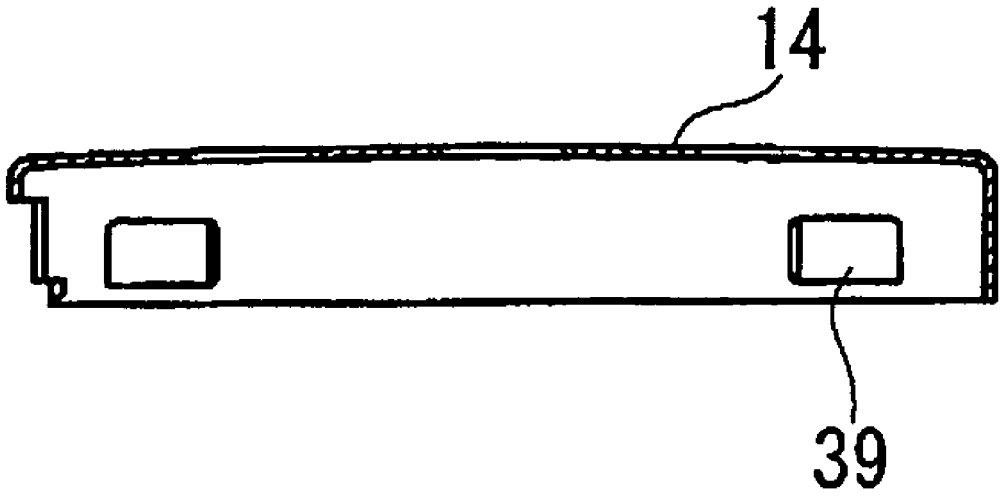
FIG. 4 is a sectional view of a cover member in the case for containing the electrical instrument.
Figure 9:
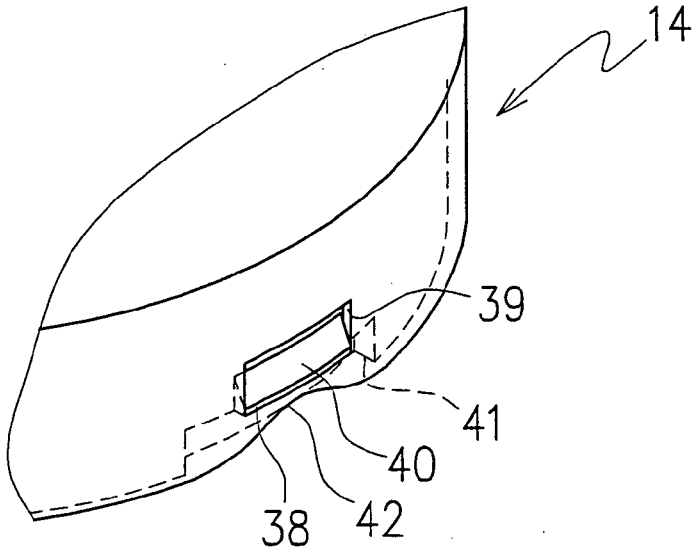
FIG. 9 is a partial perspective view of the cover and frame in engagement with one another showing the deformed portion according to one embodiment.

The lock part, when a portion of the peripheral wall portion 18 of the cover member 14 is deformed toward the frame 13, for example, includes on or more concave portions 41 (FIGS.2 and 5) formed on the peripheral wall portion 16 of the frame 13 so as to contain the deformed portion 42, as shown in FIGS. 3, 4, and 9. Each of the concave portions is formed into an elongated band shape, for example, in the embodiment, as shown in FIG.5.

The concave portions 41 are also preferably disposed in the vicinity of the protrusions 38 in downward positions thereof. This is for the reason that the lock part locks the cover member 14 to the frame 13 to prevent the engagement of the protrusions 38 of the frame 13 and holes 39 of the cover member 14 from removing, if the lock part is disposed near the protrusions 38, as described above.

As shown in FIG. 4 and 5, in the final process of assembling the speaker 11, the cover member 14 is covered from above the frame 13 on which the ring 30 is mounted, with the cover member aligned with the frame, the cover member 14 is fitted on the frame 13, and the protrusions 38 of the frame 13 are inserted in the holes 39 of the cover member 14. Subsequently, as shown in FIGS.2 and 3, portions of the peripheral wall portion 18 of the cover member 14 facing the concave portions 41 are deformed toward the frame 13 as shown by arrows in FIGS. 2 and 3, and the deformed portions 42 are driven in the concave portions 41 (see FIGS. 7–9). The cover member 14 is thereby fixed firmly on the frame 13.

In addition, in the aforementioned embodiment, although the material of the frame 13 is described as the resin, in stead, a metal may be used. In this case, preferably, the metal may be, for example, a nonmagnetic material such as aluminum, brass or the like, but are not necessarily limited to the material.

Furthermore, in the above embodiment, although the plurality of protrusions 38 is provided on the frame 13, at least one protrusion may be provided on the frame 13. In addition, the protrusions 38 may not be necessarily provided in the equally spaced arrangement.

According to the present invention, because the protrusions of the frame are inserted into the holes of the cover member, the integration of the cover member to the frame is easy, in particular, it is advantageous to execute the automatization. Because the adhesive process is eliminated, it is intended to reduce the cost of the adhesive, a provision of adhesive and the number of process of adhesive. Furthermore, the height of the made speaker is uniform, and it is possible to make a frame and a cover member having a combined force withstanding sufficiently to an impact of drop or the like. In addition, after the snap fit of the protrusions and holes, a portion of the peripheral wall portion of the cover member is bent in the concave portion of the frame and therefore it is possible to obtain a more sufficient combined force of the frame and the cover member.

In the speaker assembled as described above, the assembly can be carried out with the uniform height and the automatization is carried out easily. It is also possible to obtain a speaker contributing to cost reduction, withstanding drop impact, having a stable quality and a high reliability.

What is claimed is:

1. A case for containing an electrical instrument, comprising:

a frame having peripheral wall portions;

a cover member having peripheral wall portions and configured to cover the frame and form a space for containing the electrical instrument between the frame and the cover member, the peripheral wall portions of the cover member being configured to engage with the peripheral wall portions of the frame;

at least one hole passing through one of the peripheral wall portions of the frame and the cover member; and at least one protrusion each having a smoothly inclined surface, the at least one protrusion being provided on the other of the peripheral wall portions of the frame and the cover member, and wherein when the cover member is fitted on the frame, an opening edge of the hole hurdles the smoothly inclined surface so that the protrusion is inserted into the hole to fix the cover member to the frame.

2. The case according to claim 1, wherein said electrical instrument has a vibrating plate fixed to the frame and a magnetic circuit attached on the frame to vibrate the vibrating plate.

3. The case according to claim 1, wherein a plurality of protrusions are provided on one of the frame and the cover member, and a plurality of holes in which the protrusions are inserted are provided in the other of the frame and the cover member, said protrusions and holes each being arranged to be spaced peripherally of the frame and cover member and to face each other.

4. A micro-speaker comprising:

a frame;

a sound generator attached to the frame and including a vibrating plate to which a voice coil is fixed, a yoke, a magnet fixed to the yoke, and a top plate fixed to the magnet;

a cover member configured to cover the frame;

a plurality of protrusions provided on a peripheral wall portion of the frame and each having a smoothly inclined surface; and a plurality of holes passing through a peripheral wall of the cover member and provided for receiving the protrusions being inserted therein;

wherein when the cover member is fitted on the frame, an opening edge of each of the holes hurdles the smoothly inclined surface of each of the protrusions so that the protrusions are inserted into the holes to fix the cover member to the frame.

5. A case for containing an electrical instrument, comprising:

a frame having peripheral wall portions;

a cover member having peripheral wall portions configured to engage with the peripheral wall portion of the frame, and configured to cover the frame and to form a space for containing the electrical instrument between the frame and the cover member;

at least one protrusion having a smoothly inclined surface provided on the peripheral wall of the frame;

at least one concave portion adjacent to the protrusion provided in the peripheral wall portion of the frame; and at least one hole passing through the peripheral wall portion of the cover member, wherein when the cover member is fitted on the frame, an opening edge of the hole hurdles the smoothly inclined surface so that the protrusion is inserted into the hole, and then; at least one deformed portion, is formed by pressing the cover member from outside into the concave portion of the frame.

6. The case according to claim 5, wherein said electrical instrument has a vibrating plate fixed to the frame and a magnetic circuit attached on the frame to vibrate the vibrating plate.

7. The case according to claim 5, wherein a plurality of protrusions are provided the peripheral wall portion of the frame, and a plurality of holes configured for receiving the protrusions inserted therein provided in the peripheral wall portion of the cover member, the protrusions and the holes each being arranged to be spaced peripherally of the frame and cover member and to face each other.

8. A micro-speaker comprising:

a frame;

a sound generator attached to the frame and including a vibrating plate to which a voice coil is fixed, a yoke, a magnet fixed to the yoke, and a top plate fixed to the magnet;

a cover member configured to cover the frame for protecting the vibrating plate;

a plurality of protrusions provided on a peripheral wall portion of the frame and each having a smoothly inclined surface;

a plurality of holes passing through the peripheral wall portion of the cover member and provided for receiving the protrusions inserted therein; and at least one concave portion formed in the peripheral wall portion of the frame adjacent to one of the protrusions, wherein when the cover member is fitted on the frame, and opening edge of each of the holes hurdles the smoothly inclined surface so that each of the protrusions is inserted into the hole to fix the cover member to the frame, and then at least one deformed portion is formed by pressing the cover member from outside into the concave portion of the frame.

* * * * *